US006070296A

United States Patent [19]

Abeln et al.

[11] Patent Number: 6,070,296

[45] Date of Patent: Jun. 6, 2000

[54] DETACHABLE DOOR HINGE FOR MOTOR VEHICLE DOORS

[75] Inventors: Peter Abeln, Remscheid; Bernd Alfred Klütting, Radevormwald; Heinz-Walter Heinemann, Wuppertal; Klaus Menten, Remscheid, all of Germany

[73] Assignee: Ed. Scharwächter GmbH, Remscheid, Germany

[21] Appl. No.: 08/982,060

[22] Filed: Dec. 1, 1997

[30] Foreign Application Priority Data

Nov. 30, 1996 [DE] Germany ..... 296 20 782
Dec. 18, 1996 [DE] Germany ..... 196 52 625

[51] Int. Cl.[7] ..... E05D 7/10

[52] U.S. Cl. ..... 16/261; 16/265; 16/334

[58] Field of Search ..... 16/331, 332, 334, 16/327, 263

[56] References Cited

U.S. PATENT DOCUMENTS 2,922,669 1/1960 Hansen ..... 287/14
5,551,123 9/1996 Bartlett ..... 16/257
5,570,498 11/1996 Hipkiss et al. ..... 16/258

FOREIGN PATENT DOCUMENTS 2657112 7/1991 France ..... 16/334

*Primary Examiner*—Anthony Knight
*Assistant Examiner*—Lewis Nguyen
*Attorney, Agent, or Firm*—Brown & Wood, LLP

[57] ABSTRACT

A detachable door hinge for motor vehicle doors which includes two hinge halves securable to a door and a door pillar, respectively, two hinge pin stubs fixedly secured in respective gudgeons of one of the two hinge halves and extending, in an attached position of the hinge, into complementary gudgeons of another one of the two hinge halves, with each of the two hinge halves being formed of a folded section of sheet metal and having, at least in a region of a hinge axis, a U-shaped cross-sectional profile, with respective gudgeons being formed in legs of respective hinge halves, and with the hinge further including elements for mutually locking the two hinge halves in their pivotal positions corresponding to both a closed position of the door and a partially open position of the door.

13 Claims, 2 Drawing Sheets

DETACHABLE DOOR HINGE FOR MOTOR VEHICLE DOORS

BACKGROUND OF THE INVENTION

1. Field of the Invention

The present invention relates to a detachable door hinge for motor vehicle doors and including two hinge halves securable to parts of a motor vehicle door assembly, a door and a door pillar, respectively, with each of the two hinge halves having two spaced, aligned with each other gudgeons, and two hinge pin stubs fixedly secured in respective gudgeons of one of the two hinge halves, with the two hinge pin stubs extending, in an attached position of the hinge, into complementary gudgeons of another one of the two hinge halves, and with the two hinge halves being provided, respectively, with cooperating projections and recesses which, in the attached position of the hinge, engage each other to prevent an accidental detachment of the hinge.

2. Description of the Prior Art

A detachable door hinge for motor vehicles doors of a type discussed above is disclosed, e.g., in German Publication No. DE-36 44 576. In the conventional hinges of this type, the object of the substitution of the hinge pin with a pair of hinge pin stubs, is to achieve a maximum possible reduction of the lift height of the hinge, i.e., of the lift stroke which is necessary for separating two hinge halves from each other. In the conventional door hinges of this type, both hinge halves are formed of elongate sections of a massive profile which leads, in particular with a large distance between the hinge axis and the hinge attachment flange, to a relatively large weight of the hinge and, because of the use of the massive profile, to a relatively complicated processing and, thereby, to increased manufacturing costs. Further, the conventional door hinges of the above-described type cooperate usually with door locks which limit the maximum allowable opening angle of a motor vehicle door, and are provided with means for preventing detachment of the hinge halves when they are already mounted in a motor vehicle. However, during the transportation from the hinge manufacturing cite to the assembly cite, these means does not prevent the hinge halves from falling out. Further, in many cases, it is desirable to have a possibility to install the hinge in a position corresponding to a partially open position of the door in order to facilitate mounting of the door.

Accordingly, an object of the present invention is to provide a hinge of the above-described type which would have reduced manufacturing and assembly costs.

A further object of the present invention is to provide a door hinge of the above described type having means preventing an accidental detachment of the hinge halves during their transportation, e.g., from a manufacturing cite to an assembly cite.

A still further object of the present invention is to provide a hinge of the above-described type in which stopping of lifting of both hinge halves in their positions, corresponding to a partially open position of a motor vehicle door, is insured.

SUMMARY OF THE INVENTION

These and other objects of the present invention, which will become apparent hereinafter, are achieved by forming each of the two hinge halves of a folded section of sheet metal with each of the hinge halves having, at least in a region of a hinge axis, a U-shaped cross-sectional profile with respective gudgeons being formed in legs of respective hinge halves, and by incorporating, into the hinge, means for mutually locking the two hinge halves in a pivotal position thereof corresponding to both a closed position of the door and a partially open position of the door.

In a preferred embodiment of the present invention, the bases of the U-shaped profiles of the two hinge halves overlap in such a way that a leg of one of the hinge halves engages between the legs of another of the hinge halves. Preferably, the hinge pin stubs are secured in the gudgeons of the overlapped hinge half and, in an assembled condition of the hinge, engage in the gudgeons of the overlapping hinge half.

At the same time, the legs of the U-shaped profiles of both hinge halves are so formed that they overlap each other over the entire possible pivotal region of the hinge. The prevention of detachment of the hinge mounted in a motor vehicle becomes possible, according to the present invention, by providing in the base of the overlapping hinge half a slot extending parallel to and adjoining a leg of the overlapping hinge half for receiving an associated leg of the overlapped hinge half. The length of the slot is so selected that at least in a closed position of a vehicle door, the leg of the overlapped hinge half is engaged therein. For attachment and detachment of the hinge, there is further provided, in the base of the overlapping hinge half, a widened recess adjoining the slot and extending in the direction of the hinge axis. The width of the widened recess corresponds to a length of a portion of a respective hinge pin stub projecting beyond the gudgeon of the overlapping hinge half which is formed in the leg of the overlapping hinge half which is adjoined by the slot. This provides for attachment and detachment of the hinge in a position of the hinge halves corresponding to both a closed position of the hinge and a partially open position of the hinge.

In a preferred embodiment of the hinge according to the invention having a reduced weight, the legs of the overlapped hinge halves have, in a region of the hinge support, a height extending beyond the gudgeons formed in the legs. The height of the leg portions beneath the gudgeons is reduced, over the entire longitudinal extent of the overlapped hinge half, to a height of inwardly bent rims of the base of the overlapped hinge half. In the portions of the legs having an increased height, the height is so selected that in a closed position of the door, the portions with the increased height are engaged in respective slots of the overlapping hinge half.

For limiting the opening angle of the vehicle door or the pivotal movement of the door, at least one of the two legs of the overlapping hinge half has a free-cut projection extending radially to the hinge axis and cooperating with an inwardly extending rim protrusion at the adjacent end of the base of the overlapped hinge half.

According to another embodiment of the present invention a detent spring is arranged on one of the legs of the overlapping hinge half. The detent spring is formed of a section of spring steel sheet and is pivotally supported on an outer surface of the one of the legs for pivotal movement about an axis concentric with the hinge axis. The detent spring has two, opposite with respect to the hinge axis, arms, with one of the arms having substantially trapezoidal profile and having, in its end region, two spaced detent projections lying on a circle concentric with respect to the hinge axis, and with another of the arms having a retaining nose.

The two spaced detent projections insure retaining of the spring on one of the hinge half in two different pivotal position of the detent spring, which is pivotally supported on the one of the two hinge halves. The arm of the detent spring, which is provided with a retaining nose, form-lockingly engages the other of the two hinge halves. This arrangement of the detent spring insures that the detent spring, in the first pivotal position thereof, provides for locking of the two hinge halves in a position corresponding to the closed position of the vehicle door, and provides, in the second pivotal position thereof, for locking of the two hinge halves in a position corresponding to a partially open position of the vehicle door. The detent spring is so connected with the respective hinge pin stub for joint rotation therewith that, upon the door being mounted in the vehicle, the detent spring can be replaced with a correspondingly formed spring clip.

The detent spring can be pivotally mounted either in the gudgeon, e.g., the detent spring can be provided with a collar or the like engageable in the gudgeon, or be mounted on the respective hinge pin stub.

For selectively securing the detent spring in two pivotal positions, the side surface of the spring-carrying leg is provided with a detent recess which cooperates with the two detent projections formed on the inner arm of the detent spring.

The retaining nose of the detent spring is formed at an end of a bent-our portion of the another of the arms which encompasses the one of the legs of the overlapping hinge half. The retaining note, at least in a pivotal position of the detent spring, cooperates with a front end of the base of the overlapped hinge half. The retaining nose extends substantially parallel to the spring-carrying leg. Further, the detent projections, which are provided on the inner arm are so arranges that the retaining nose provides for an increase of a pivotability of the overlapped hinge half, in particular, in the position of the overlapped hinge half corresponding to the closed position of the door.

In accordance with a further advantageous development of the present invention, it is provided that the base and/or the legs of the at least overlapping hinge half are provided, at their ends remote from the gudgeons, with bent-out portions extending substantially perpendicular to the longitudinal extent of the hinge half and having in their bent-out regions inwardly stamped beads which form stiffening elements. In a preferred embodiment of the hinge, the stamped beads are provide in the middle of the bent-out regions.

The two hinge pin stubs, which form hinge journals, can be formed as head bolts and be retained in the gudgeons of the overlapped spring hinge with a circumferential knurling or likewise functioning circumferential profile, which retains the hinge pin stubs against rotation and axial displacement relative to the retaining gudgeons. The stub portions, extending beyond the respective gudgeons and serving as bearing journals, are received in the gudgeons of the overlapping hinge half in bearing sleeves formed of a maintenance-free material, is material that does not require lubrication.

The overlapping hinge half is secured on the respective door part by welding. The bent-out portions of the base and the legs of the overlapping hinge half form connection flanges. To provide for access of a welding tool, the base connection flange is bent inwardly while the leg connection flanges are bent-out outwardly.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 2:
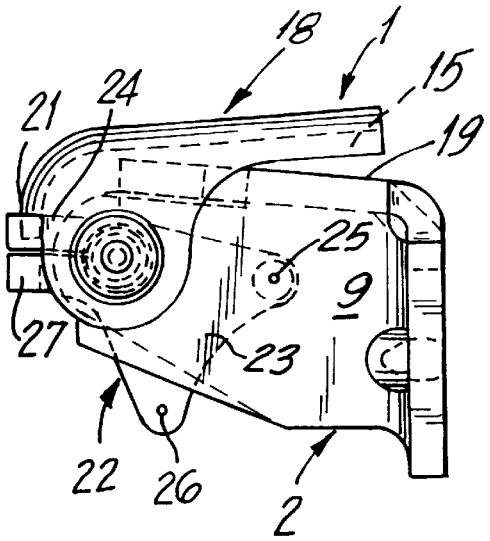
FIG. 2 shows a side view of the door hinge shown in FIG. 1.
Figure 3:
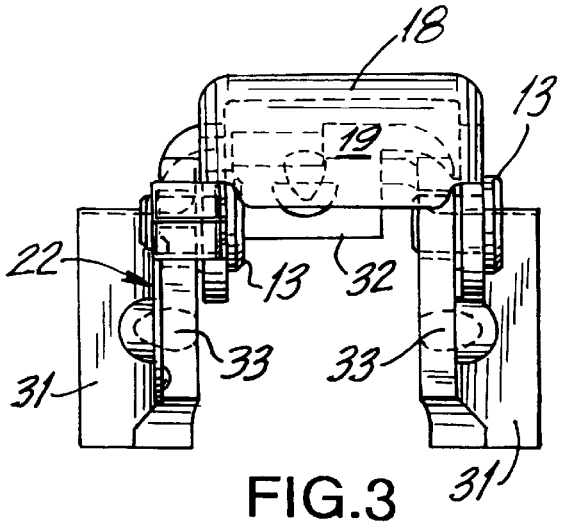
FIG. 3 shows a front view of the door hinge shown in FIGS. 1–2.
Figure 1:
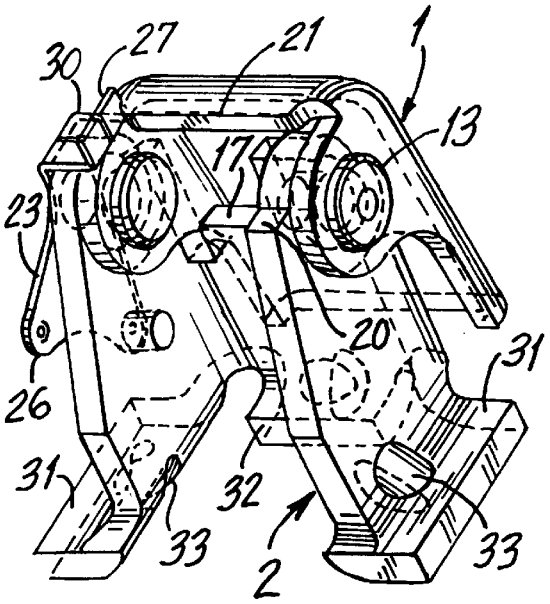
FIG. 1 shows an operational perspective view of a motor vehicle door hinge according to the present invention.
Figure 4:
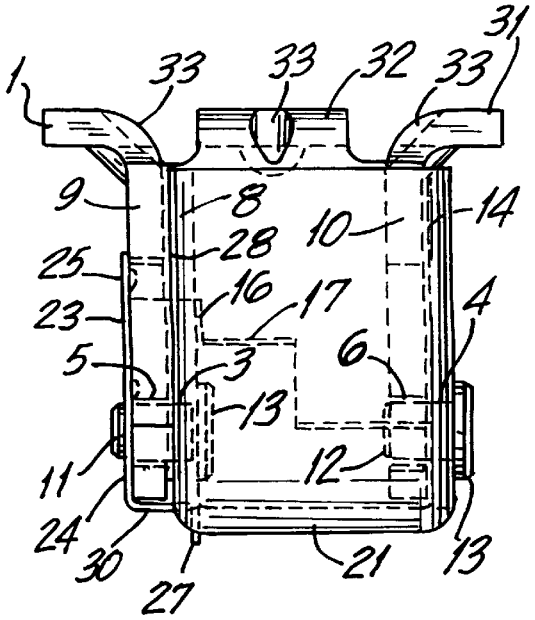
FIG. 4 shows peak view of the door hinge shown in FIGS. 1–3.
Figure 5:
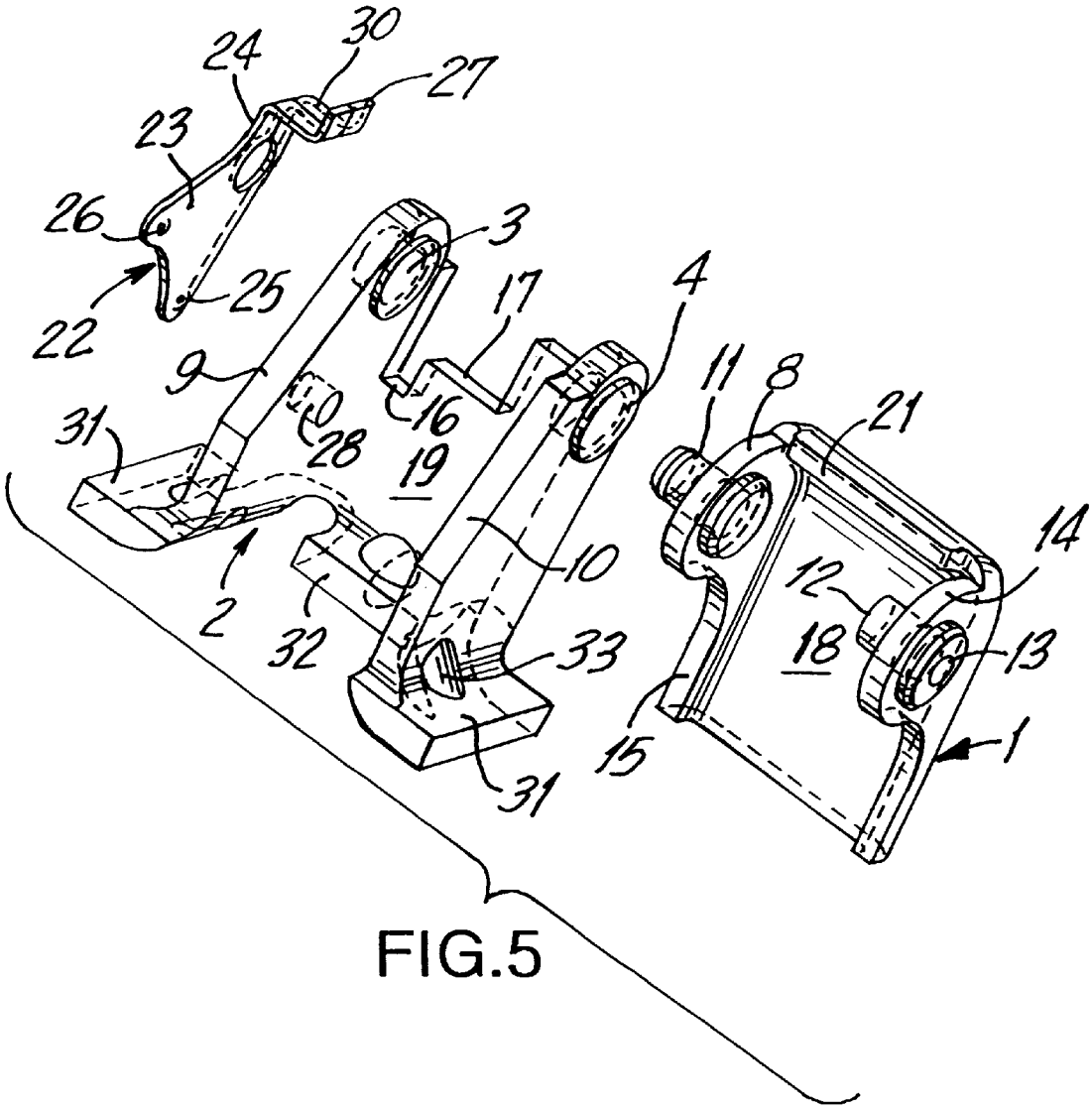
FIG. 5 shows an exploded view of the door hinge shown in FIGS. 1–4.

A detachable door hinge for motor vehicles doors according to the present invention, which is shown in the drawings, includes two hinge halves 1 and 2 which are connected, respectively, to a door part, a door or a door pillar and each of which has two spaced, aligned gudgeons 3, 4 and 5, 6, respectively. Both door hinge halves 1, 2 are formed each of a folded sheet metal section and each has, at least in the region of the hinge axis 7, a U-shaped cross-sectional profile. The bases 18 and 19 of the U-shaped profiles of the two hinge halves overlap each other, with the leg 8 of the first hinge half 1 being located between legs 9 and 10 of the second hinge half 2. The first hinge half 1 is provided with two hinge pin stubs 11 and 12 which form bearing journals. The stubs 11 and 12 have each a circumferential knurling, and each extends through a respective gudgeon 3, 4, being fixedly secured therein. In a mounted condition of the hinge, the stubs 11, 12, which form bearing journals engage in the complementary gudgeons 5, 6 of the second hinge half 2.

In the embodiment shown in the drawings, each of the hinge pin stubs 11, 12 is formed as a head bolt abutting with its head 13 inner or outer surface of the legs 8 and 14, respectively. An opposite arrangement of the screw bolts is also possible when the heads 13 of the two bolts engage, respectively, outer or inner surfaces of the legs 8 and 13 of the first hinge half 1. The end portions of the hinge pin stubs 11 and 12 which form bearing journals are received in respective gudgeons 5,6 of the second hinge half 2 in bearing sleeves formed of a maintenance-free bearing material.

The legs 8 and 14 of the first hinge half 1 have, in the region of the hinge axis, a height projecting beyond the gudgeons 3, 4, 5, 6, and have their height reduced over the length of the remaining portion to a height of a bent rim portion 15 of the base 18. A slot-like recess 16 is cut out in the base 19 of the second hinge half 2 adjacent to a leg 9 of the second hinge half 2 which extends parallel to the leg 8 of the first hinge half. In the second hinge half 2, adjacent to the slot-like recess 16, a widened recess 17, the width of which substantially corresponds to a length of the portion of the hinge pin stub 11 extending beyond the gudgeon 3, is formed. The length of the slot-like recess 16 is so selected that at least in a closed position of a vehicle door, the leg 8 of the first hinge half 1 is engaged therein. Thus, attachment and detachment of both hinge halves 1 and 2 becomes possible in a pivotal position of the hinge halves 1, 2 corresponding to a partially opened position of the door.

To form a stop which would limit the opening of the door, i.e., would limit pivotal angle, a projection 20, which extends radially with respect to the hinge axis 7, is formed on the second hinge half 2. The projection 20 cooperates with an inwardly extending rim protrusion 21 of the base 18 of the first hinge half 1.

A detent spring 22 is supported on the second hinge half 2 in a region of the second hinge half 2 external to both legs 9 and 10. The detent spring 22 is formed of a section of spring steel sheet and is pivotable about an axis concentric with the hinge axis 7. The spring 22 has two arms 23 and 24 located opposite each other with respect to the hinge axis 7. The arm 23 has a substantially trapezoidal shape and has two spaced detent projections 25 and 26 formed on circle concentric with respect to the hinge axis 7. The second arm 24 is provided, in its end region, with a retaining nose 27. The detent spring 22 is pivotally supported in the gudgeon 5 of the second hinge half 2. A detent recess 28, which is formed in an outer side surface of the leg 9 of the second hinge half 2, is associated with projections 25 and 26 of the detent spring 22.

The retaining nose 27, which cooperates with a gudgeon side end surface of the second hinge half 2, adjoins the bent-out portion 30 of the arm 24 which encompasses the end surface of the leg 9, and extends substantially parallel to the plane of the leg 9.

The detent projections 25, 26, which are provided on the arm 23 of the detent spring 22, are so arranged that the nose 27, which is formed on the outer arm 24 increases the pivotability of the first hinge half 1, in particular, in a position of the hinge half 1 corresponding to the door closing position.

The base 19 and the legs 9, 10 of the second hinge half 2 are provided, at their ends remote from the gudgeons 5, 6, with outwardly bent portions 32 and 31, respectively, extending transverse to the longitudinal extent of the second hinge half 2. The outwardly bent portions 31, 32 are provided with throughopenings 33 which form inwardly directed flange-like stiffening elements.

Though the present invention was shown and described with reference to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A detachable door hinge for motor vehicle doors, comprising:

two hinge halves securable to parts of a motor vehicle door assembly, a door and a door pillar, respectively, each of the two hinge halves having two spaced, aligned with each other gudgeons;

two hinge pin stubs fixedly secured in respective gudgeons of one of the two hinge halves, the two hinge pin stubs extending, in an attached position of the hinge, into complementary gudgeons of another of the two hinge halves; and means for mutually locking the two hinge halves in pivotal positions thereof corresponding to both a closed position of the door and a partially open position of the door, wherein each of the two hinge halves is formed of a folded section of sheet metal and has, at least in a region of a hinge axis, a U-shaped cross-sectional profile, with respective gudgeons being formed in legs of respective hinge halves, with the base of the another of the two hinge halves overlapping a base of the one of the two hinge halves, and with a leg of the another of the two hinge halves extending between legs of the another of the two hinge halves, and wherein the base of the another of the two hinge halves has a slot extending parallel to and adjoining a leg of the another of the two hinge halves for receiving an associated leg of the one of the two hinge halves, and a widened recess adjoining the slot and extending in a direction of the hinge axis, the widened recess having a width corresponding to a length of a portion of a respective hinge pin stub projecting beyond the gudgeon of the one of the two hinge halves.

2. A door hinge as set forth in claim 1, wherein the legs of the one of the hinge halves have, in a region of a hinge support, a height extending beyond the gudgeons.

3. A door hinge as set forth in claim 1, wherein the base of the one of the hinge halves has, at an end of the base adjacent to the gudgeons, inwardly bent rims.

4. A door hinge as set forth in claim 1, wherein the locking means comprises a detent spring arranged on one of the legs of the another of the two hinge halves, wherein the detent spring is formed of a section of spring steel sheet and is pivotally supported on an outer surface of the one of the legs for pivotal movement about an axis concentric with the hinge axis, wherein the detent spring has two, opposite with respect to the hinge axis, arms, wherein one of the arms has a substantially trapezoidal profile having, in an end region thereof, two spaced detent projections lying on a circle concentric with respect to the hinge axis, and wherein another of the arms has a retaining nose.

5. A door hinge as set forth in claim 4, wherein the detent spring is pivotally supported in the gudgeon of the one of the legs.

6. A door hinge as set forth in claim 4, wherein the detent projections of the detent spring are associated with a detent recess formed in a side surface of the one of the legs.

7. A door hinge as set forth in claim 4, wherein the retaining nose of the detent spring is formed at an end of a bent-out portion of the another of the arms which encompasses the one of the legs, and wherein the retaining nose, at least in a pivotal position of the detent spring, cooperates with a front end of the base of the one of the two halves.

8. A door hinge as set forth in claim 1, wherein the base and the legs of the other of the two overlapping hinge halves have, at ends thereof remote from the gudgeons, portions bent outwardly with respect to a longitudinal extent of the another of the two hinge halves and having, in a bent-out region thereof, inwardly stamped beads which form stiffening elements.

9. A door hinge as set forth in claim 1, wherein the hinge pin stubs are secured in the gudgeons of the one of the two hinge halves without a possibility of rotation therein and without a possibility of axial displacement relative thereto.

10. A door hinge as set forth in claim 9, wherein the hinge pin stubs are received in bearing sleeves formed of a maintenance-free material.

11. A door hinge as set forth in claim 1, wherein the base and the legs of the U-shaped profile of the other of the tvo hinge halves have, at ends thereof remote from the gudgeons, respective bent-out connection flanges extending substantially perpendicular to a longitudinal extent of the hinge.

12. A door hinge as set forth in claim 11, wherein the connection flange of the base is bent inwardly, and the connection flanges of the legs are bent outwardly.

13. A door hinge as set forth in claim 12, wherein the connection flanges of the base and the legs have, in bent-out regions thereof, inwardly stamped beads which form stiffening elements.

* * * * *